US010391410B2

(12) United States Patent
Kitchen et al.

(10) Patent No.: US 10,391,410 B2
(45) Date of Patent: Aug. 27, 2019

(54) TRACKS FOR TOWER RIDE

(71) Applicant: William J. Kitchen, Windermere, FL (US)

(72) Inventors: William J. Kitchen, Windermere, FL (US); Alan Schilke, Liberty, UT (US)

(73) Assignee: William J. Kitchen, Windermere, FL (US)

( * ) Notice: Subject to any disclaimer, the term of this patent is extended or adjusted under 35 U.S.C. 154(b) by 703 days.

(21) Appl. No.: 15/034,504

(22) PCT Filed: Nov. 17, 2014

(86) PCT No.: PCT/US2014/066007

§ 371 (c)(1),
(2) Date: May 4, 2016

(87) PCT Pub. No.: WO2015/073998

PCT Pub. Date: May 21, 2015

(65) Prior Publication Data

US 2016/0279529 A1 Sep. 29, 2016

Related U.S. Application Data

(60) Provisional application No. 61/905,250, filed on Nov. 17, 2013.

(51) Int. Cl.
*A63G 7/00* (2006.01)
*A63G 21/10* (2006.01)

(52) U.S. Cl.
CPC ..... *A63G 7/00* (2013.01); *A63G 21/10* (2013.01)

(58) Field of Classification Search
CPC . A63G 1/00; A63G 7/00; A63G 21/00; A63G 21/04
See application file for complete search history.

(56) References Cited

U.S. PATENT DOCUMENTS 468,553 A 2/1892 Shaw
6,953,377 B2 * 10/2005 Quercetti ..... A63H 18/06 104/104

(Continued)

FOREIGN PATENT DOCUMENTS

CN 102226358 A 10/2011
FR 379048 10/1907

(Continued)

OTHER PUBLICATIONS

Office action dated Sep. 25, 2018 in related Japanese patent application 2016-526011.

(Continued)

*Primary Examiner* — Robert J McCarry, Jr.
(74) *Attorney, Agent, or Firm* — Polson Intellectual Property Law, PC; Margaret Polson

(57) ABSTRACT

Track configurations for a roller coaster mounted on a tower area are disclosed. The track configurations allow the track to transition from traveling in a first direction around the circumference of the tower to a second direction around the circumference of the tower that is substantially opposite the first direction while maintaining the safety and comfort of the riders. Also disclosed is a wire rope drive to power the rider carriages up a helical track mounted on the tower, preferably on the inside the tower.

20 Claims, 14 Drawing Sheets

(56) References Cited

U.S. PATENT DOCUMENTS

| | | | |
|---|---|---|---|
| 2009/0031913 | A1 | 2/2009 | Heaslip et al. |
| 2009/0209543 | A1 | 8/2009 | Valoti et al. |
| 2013/0092043 | A1 | 4/2013 | Kitchen |

FOREIGN PATENT DOCUMENTS

| | | | |
|---|---|---|---|
| JP | 2002143569 | A | 5/2002 |
| JP | 2005029081 | A | 2/2005 |
| JP | 2006502795 | A | 1/2006 |
| JP | 2008-188384 | A | 8/2008 |
| WO | 2012162675 | A1 | 11/2012 |

OTHER PUBLICATIONS

Extended European Search report dated Jul. 17, 2017 in related European application 14862483.6.
International Search Report dated Mar. 27, 2015 in parent application PCT/US2014/066007.
Written Opinion of the International Searching Authority dated Mar. 27, 2015 in parent application PCT/US2014/066007.
International Preliminary Report on Patentability, Ch. II, dated Mar. 7, 2016 in parent application PCT/US2014/066007.
Office Action dated May 2, 2017 in related Chinese application 201480062912.X.
Office Action dated Oct. 3, 2017 in related Russian application 2016118810.

* cited by examiner

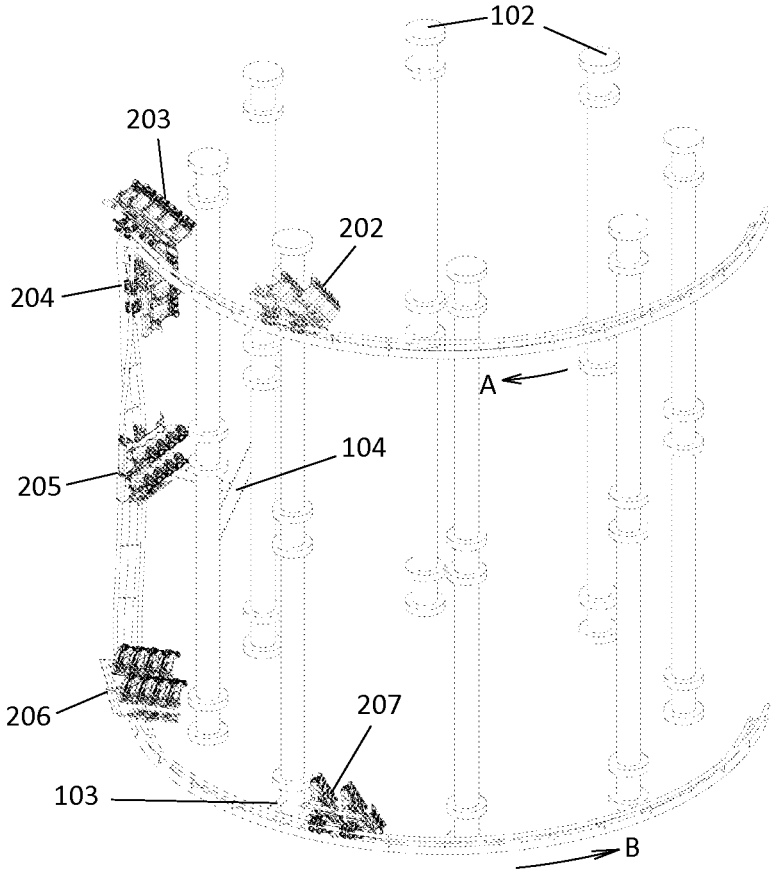
Fig. 3
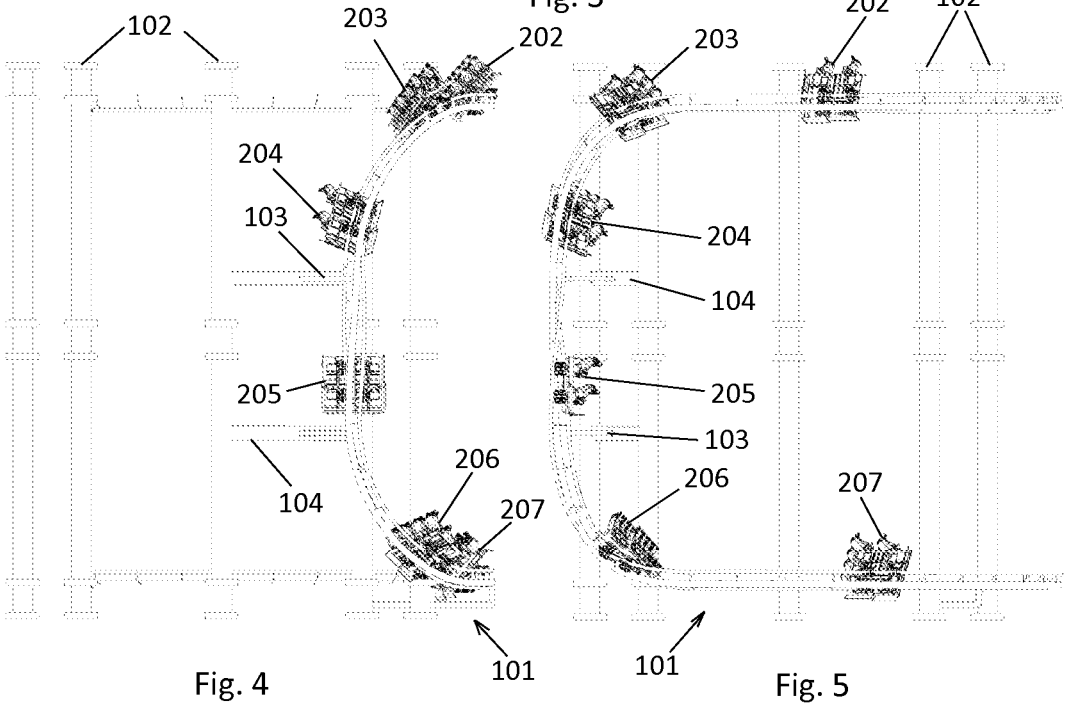
Fig. 4
Fig. 5

TRACKS FOR TOWER RIDE

CROSS REFERENCE APPLICATIONS

This application is a non-provisional application claiming the benefits of provisional application No. 61/905,250 filed Nov. 17, 2013 through PCT/US14/66007 filed Nov. 17, 2014, which are hereby incorporated by reference for all purposes.

BACKGROUND

Amusement rides with tracks on towers are known in the art. Also known from prior application WO2012/162675 is a roller coaster mounted on a tower. Mounting the track mainly on the exterior of the tower (which is done to allow the interior of the tower to function as both the "up" section of the track and contain elevators, evacuation stairs and other equipment to allow the top of the tower to have a useable retail/dining/viewing area) limits the possible maneuvers the track can be designed to perform because there is a strict limit on the distance out from the support pillars that the track can be mounted. However, mounting the track around the exterior of the tower creates the problem that all of the direction of rotation of the track curves around is in the same direction, potentially increasing motion sickness in riders. Although the tracks can be "stacked" at least two tracks deep out from the pillars without additional support from below, it is difficult for the path of the track to cross over itself too often so long as the track is mounted solely on the exterior of the tower. When the track is mounted solely on the exterior of the tower, the entire track has to remain within a roughly cylindrical space around the tower defined by the support pillars on the inside and the maximum distance the track can be out from the tower on the outside.

Due to the length of the upward track, standard chain drives used on most rollercoasters could not be used, as the weight of the chain would create too many problems. However, the height of the ride requires a very safe drive system. Chain drives and associated sprockets are very noisy, making the ride unsuitable to put into many environments that one might wish to put a ride with such a small footprint, such as a shopping area. Chain drives also require lubrication, which will possibly drip on the riders. Further, chain drives are subject to more wear than the proposed system.

The foregoing example of the related art and limitations related therewith are intended to be illustrative and not exclusive. Other limitations of the related art will become apparent to those of skill in the art upon a reading of the specification and a study of the drawings.

SUMMARY

One aspect of the present disclosure is to have a roller coaster track mounted on a tower that reverses direction of travel (and therefore rotation) around the exterior of the tower while maintaining the safety and comfort of the riders.

Another aspect of the present disclosure is to provide a direction reversing turn that maintains sufficient G force to ensure riders are pressed into their rider supports.

Another aspect of the present disclosure is to provide a direction reversing turn that can be traveled in either direction, allowing for either a drop or rise of overall location on the tower, thereby allowing riders to end up on a track located lower or higher up the tower than at the beginning of the turn.

Another aspect of the present disclosure is to provide a direction reversing turn that does not invert the riders during the turn.

Another aspect of the present disclosure is to occasionally reverse direction of rotation around the tower to try to reduce potential motion sickness of the riders.

Another aspect of the present disclosure is to occasionally reverse direction of rotation around the tower to make the ride more interesting and thrilling.

Another aspect of the present disclosure is to provide a drive system for the internal spiral up track.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

One embodiment is a drop turn where the track is headed in a first direction around on the outer perimeter of the tower, turns downward and banks about 180 degrees towards the tower while the track drops and turns about 180 degrees to end up traveling a second direction around the perimeter of the tower, the second direction being substantially opposite the first direction.

Another embodiment is a drop turn where the track is headed in a first direction around on the outer perimeter of the tower, turns downward and banks about 180 degrees away from the tower while the track drops and turns about 180 degrees to end up traveling a second direction around the perimeter of the tower, the second direction being substantially opposite the first direction.

Another embodiment is a loop turn where the track is headed in a first direction around on the outer perimeter of the tower, turns upward and then drops while banking about 180 degrees toward the tower to end up traveling a second direction around the perimeter of the tower, the second direction being substantially opposite the first direction.

Another embodiment is a loop turn where the track is headed in a first direction around on the outer perimeter of the tower, turns upward and then drops while banking about 180 degrees away from the tower to end up traveling a second direction around the perimeter of the tower, the second direction being substantially opposite the first direction.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

The present disclosure will be explained in greater detail below on the basis of embodiments with reference to the following figures:

FIG. 3 is another perspective view of the drop turn of FIG. 2;

FIG. 4 is a first side plan view of FIG. 3;

FIG. 5 is a second side plan view of FIG. 3;

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

Figure 1:
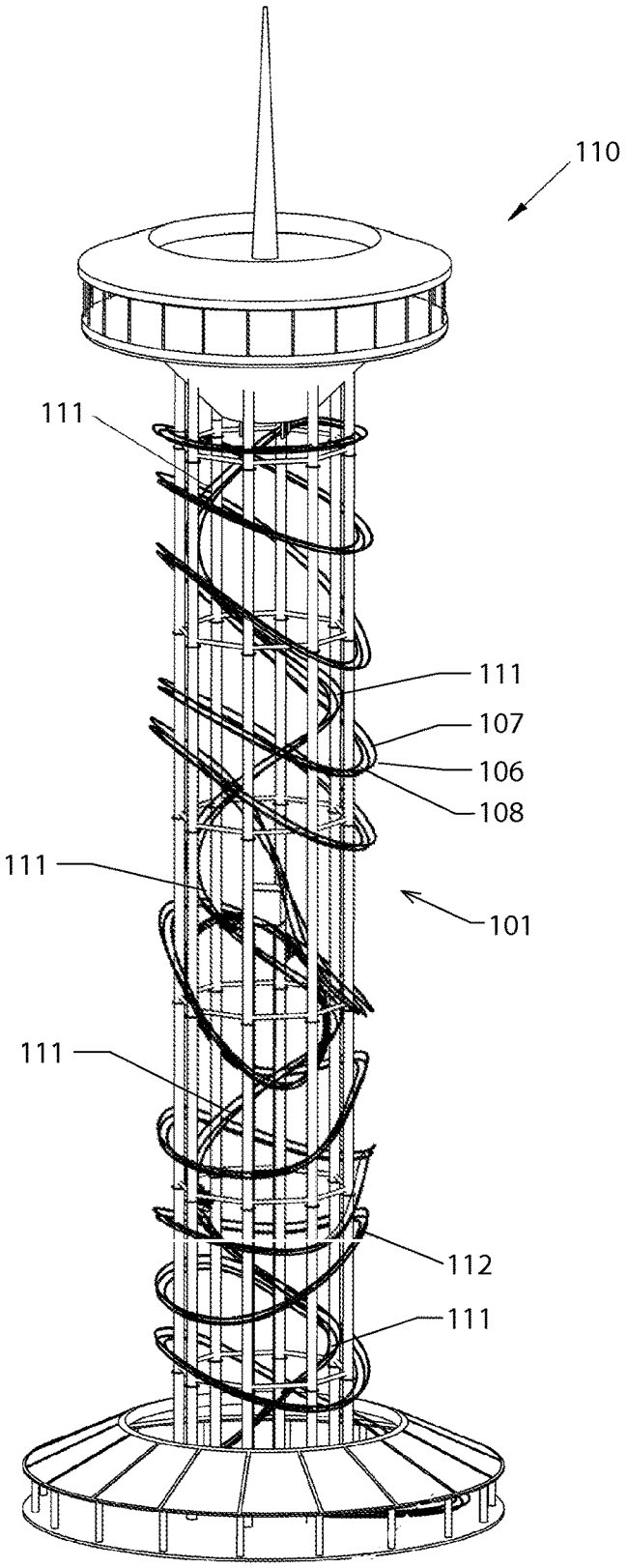
FIG. 1 is a perspective view of a roller coaster embodiment of a tower ride with a spiral inner track.

FIG. 1 is a perspective view of an embodiment of a tower 110 having a coaster ride with track 101. The section of the track 111 that is driven and moves the carriages or "cars" upward would be in the inner diameter in the depicted embodiment. The tower would likely be at least 45 meters (about 150 feet) tall and can be as tall as 2000 feet or taller. This means that the ascending helical track will be at least two to three times the height of the tower, depending on the height of the tower. The outer section of the track 112 would loop and change pitch as shown for a coaster ride down the tower 110. Other configurations of the upward track and the downward track are possible, and no limitation is intended or should be inferred by this depiction. The track 101 in the depicted embodiment is a tri-cord truss track with a first rail 106, a second rail 107 and a spine rail 108. Other types of track are possible, and no limitation is intended or should be inferred by this depiction. The first and second rails are the rails the rider carriage is mounted on and moves along in operation of the ride. The first and second rail are substantially parallel to each other.

All references to the direction of the track contained herein are in reference to the direction of travel of the rider carriages during the normal operation of the ride. Along and/or down the track means the rider carriage has moved along the track in the normal direction of travel and does not refer to an actual drop in height from the ground of the rider carriage. The degree of bank of the track refers to the rotation of the track plane formed by the first and second rails around the spine rail from a starting position at a loading station (not shown). At most loading stations the first rail 106 and the second rail 107 are in the same horizontal plane with each other and substantially level with the ground in the normal loading configuration. This position is 0 degree bank. Note that 0 degree bank will not always have the riders in an upright position because the track itself can be at orientations other than level. The orientation of the ride is dependent on both the orientation of the track and the degree of bank. Right and left bank are relative to the rider loaded in the rider carriage facing forward in the direction of travel of rider carriage. A 45 degree left bank is describing the plane of the track being at 45 degrees on the left side of the spine rail. The turns disclosed herein will be described in terms of the depicted embodiments. As long as the configuration of the turns is maintained, the exact degrees of bank the track rotates through and/or the starting and ending degrees of bank of the track are not limited to the depicted embodiments. In practice, many variations of the position of the rider carriage, including variations of the starting bank and turn position of the track and ending bank and turn position of the track will be used in practice, as it is desirable for the riders to have a number of different experiences with turns and it is expected that there would be multiple turns on a given track to change the direction of travel around the tower multiple times for the riders. Additionally all of the G forces described herein are based upon calculations done with simulators. The G forces are estimates for the purposes of description and no variations of actual G force encountered in an actual ride indicate a failure to practice the described turns.

Referring next to FIGS. 2-5, the track 101 is mounted on support pillars 102 in a drop turn 201 configuration with the initial turn being toward the support pillars. For ease of viewing only the drop turn segment of the track is shown. It is to be understood that the track would continue both before and after the drop turn. The drop turn has an overall C shaped configuration. The number, size and spacing of the support pillars will depend on the height and total diameter of the tower 110; no limitation as to the size and spacing of the pillars is intended, or should be inferred. The mounting braces 103, 104 are not shown in FIG. 2 and are shown in FIGS. 3-6. The number and size of the cross braces required to support the track 101 will depend on well-known engineering principles. Individual rider carriages 105 are shown spaced apart at different locations on the track 101. The location and spacing of the rider carriages shown is to illustrate the orientation of the track at various locations on the turn of the depicted embodiment. The depicted rider carriage configuration is not intended as an illustration of the actual spacing of the rider carriages during operation of the tower ride. The ride can be operated with either individual rider carriages traveling the track or with trains of rider carriages (not shown). No limitation to the number, spacing or type of rider carriages is intended or should be inferred.

Figure 2:
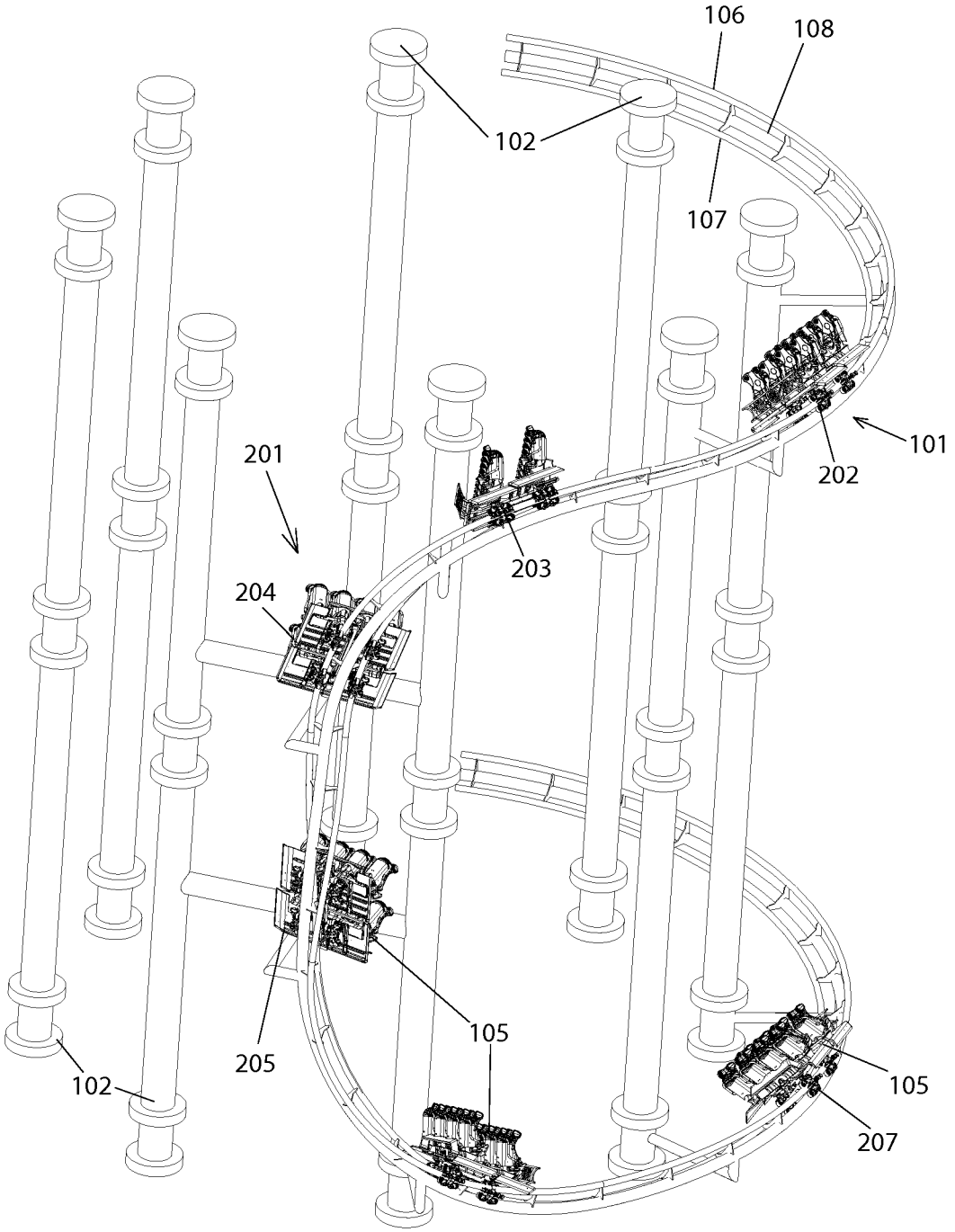
FIG. 2 is a perspective view of a drop turn.

The drop turn 201 starts with the rider carriage at a first position 202 on track 101. The rider carriage is traveling in a first direction indicated by arrow A (shown in FIG. 3) around the circumference of the tower along the track 101. The track has a 45 degree right bank at the first position and a rider traveling at 15 MPH would experience about 1.5 G in the depicted embodiment. The rider carriage 105 travels down the track extending along the upper part of the C-shaped drop turn to a second position 203 where the track 101 starts to turn downward at the upper curve of the C as best seen in FIG. 2. The rider carriage then travels down the track extending along spine of the C to a third position 204, at which point the track has rotated about 45 degrees toward the tower from the first position 202 to be at a 90 degree right bank in the depicted embodiment. In the depicted embodiment, a rider traveling at about 20 MPH would experience about 1 G of force at the third position 204.

Figure 6:
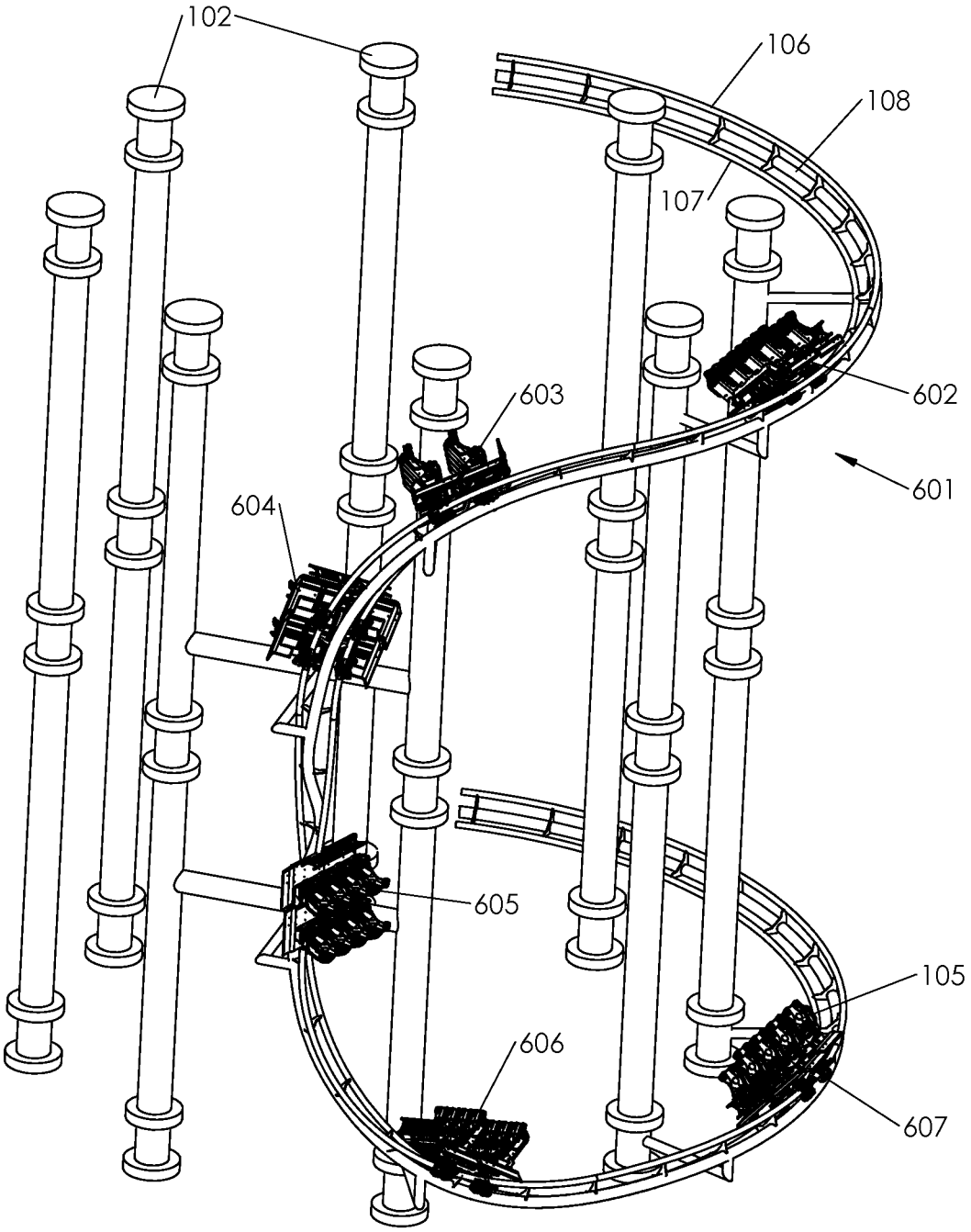
FIG. 6 is a perspective view of a drop turn that rotated outward showing the support pillars and the track.

The rider carriage then travels down the track 101 extending to a fourth position 205 about two thirds of the way down the spine of the C, as best seen in FIGS. 5 and 6. At the fourth position 205, the downward oriented track has banked a further 70 degrees right from the third position, resulting in an actual right bank of approximately 150 degrees. A rider traveling at 30 MPH would experience approximately 2.5 Gs at the fourth location 205 on the track.

The track 101 then extends down the track to a fifth position 206 at the lower curve of the C. The track has rotated 30 degrees from position four, resulting in 0 degree bank in the depicted embodiment. In the depicted embodiment a rider traveling at 40 MPH would experience about 3.5 Gs. The rider carriage then travels down the track 101 extending to a sixth position 207 located on the lower arm of the C. The track is headed and rider carriage is now traveling in a second direction indicated by arrow B (shown in FIG. 3) around the circumference of the tower, which is substantially opposite the first direction indicated by arrow A. It should be appreciated that the degrees of bank at any given location can be varied depending on the desired rider experience.

Figure 7:
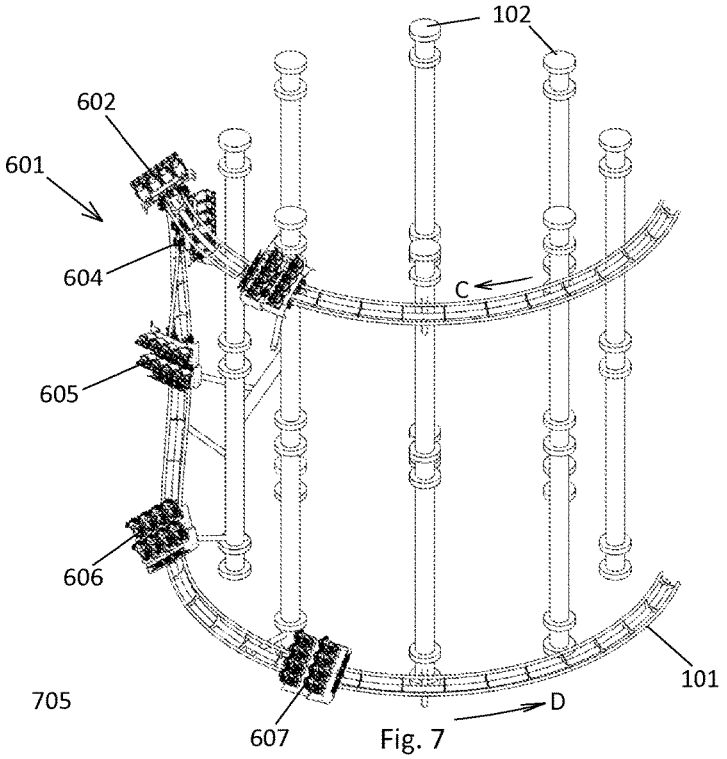
FIG. 7 is another perspective view of the drop turn of FIG. 6.
Figure 8:
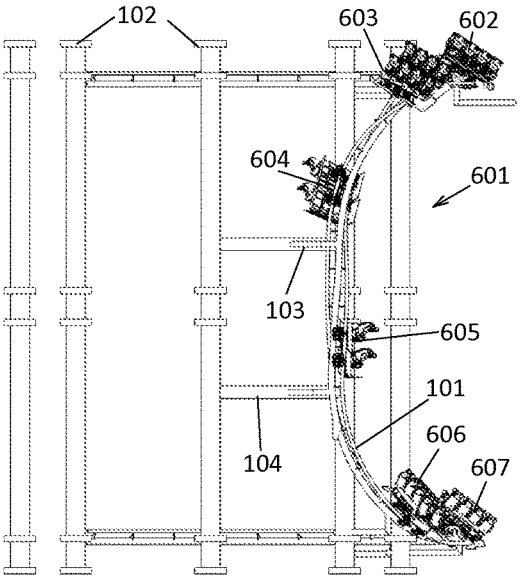
FIG. 8 is a first side plan view of FIG. 7.
Figure 9:
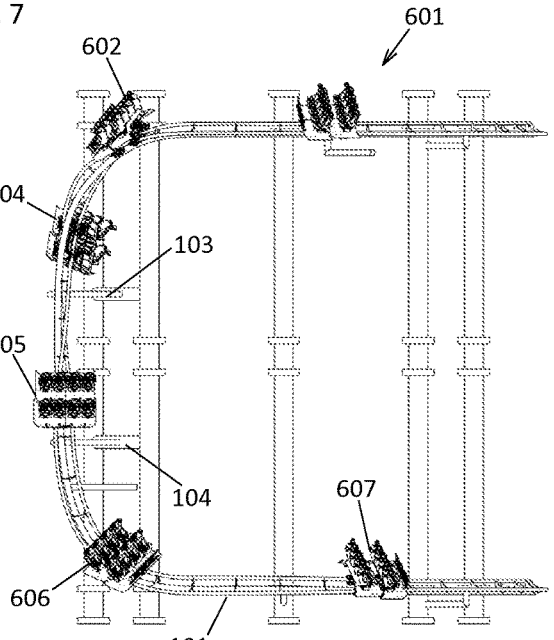
FIG. 9 is a second side plan view of FIG. 7.
Figure 10:
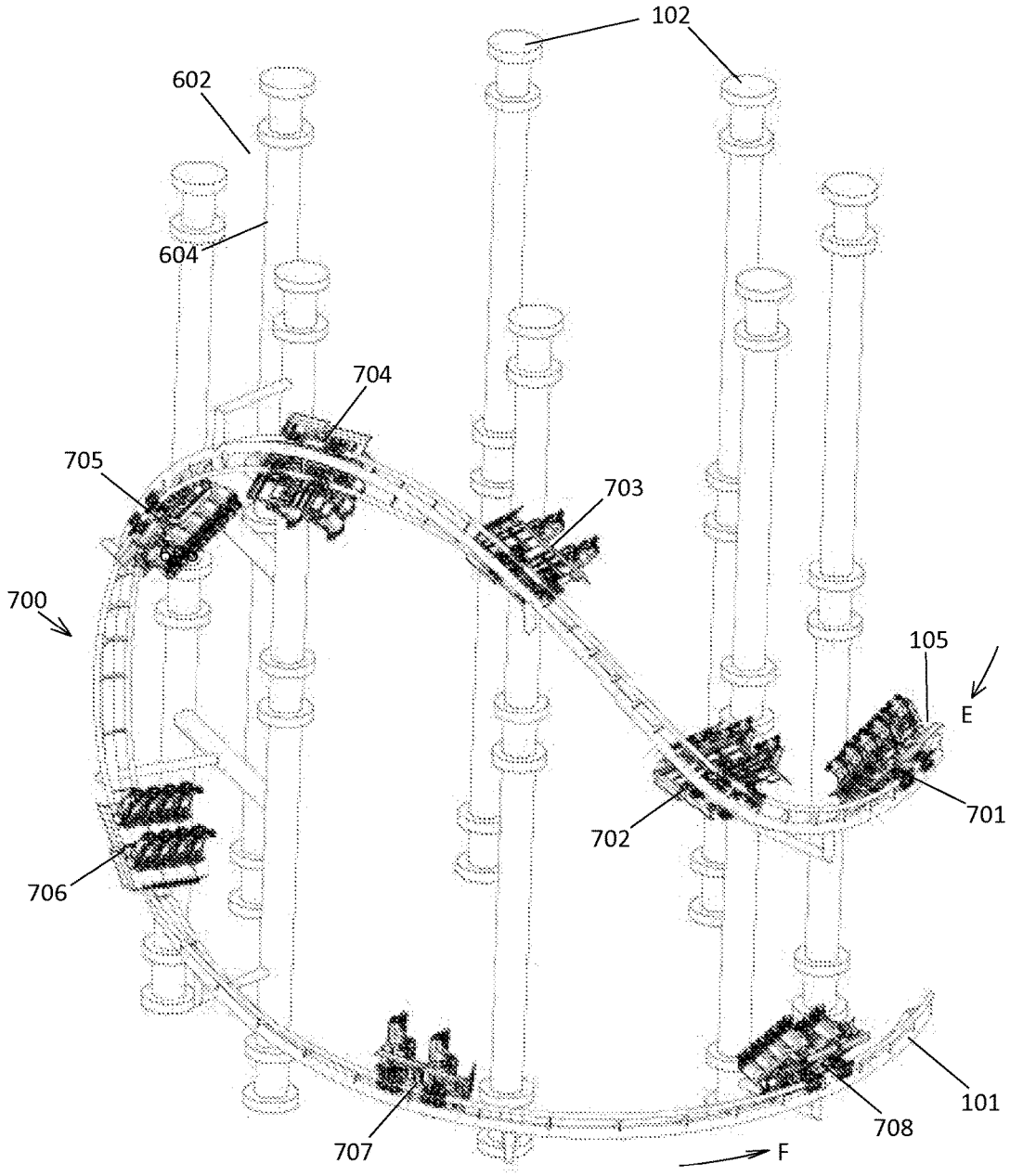
FIG. 10 is a perspective view of a loop turn.

Referring next to FIGS. 6-9, a drop turn 601 can also be completed where the track banks outward from the tower 110. The drop turn 601 starts with the rider carriage at a first position 602 on track 101. The rider carriage is traveling is a first direction shown by arrow C (shown in FIG. 7) around the circumference of the tower along the track 101. The rider carriage 105 travels down the track extending along other upper part of the C-shaped drop turn to a second position 303 where the track 101 starts to turn downward at the upper curve of the C, as best seen in FIGS. 6 and 8. The rider carriage then travels down the track extending along spine of the C to a third position 604 and the track has rotated about 45 degrees away from the tower as in the depicted embodiment at position 604.

The rider carriage then travels down the track 101 extending to a fourth position 605 about two thirds of the way down the spine of the C, as best seen in FIGS. 7 and 8.

The track then extends down the track to a fifth position 606 at the lower curve of the C. The track has rotated 30 degrees from position four, resulting in a 60 degree bank left in the depicted embodiment. In the depicted embodiment a rider traveling at 40 MPH would experience about 3.5 Gs. The rider carriage then travels down the track extending to a sixth position 607 located on the lower arm of the C. The track is headed and rider carriage is now traveling in a second direction around the circumference of the tower indicated by arrow D (shown in FIG. 7), which is substantially opposite the first direction indicated by arrow C. It should be appreciated that the degrees of bank at any given location can be varied depending on the desired rider experience.

The velocity, bank angle, and G-force will vary from the depicted embodiment based on the tower's diameters. The drop turn can occur with or without breaking. The banking roll can occur towards the tower with 180 degrees of bank transition or by rolling away from the tower with 180 degrees of bank transition. The rider carriage 105 can bank early to fully invert riders before dropping as shown, or bank late for a non-inverting maneuver. Further, exactly where in the overall C turn the banking occurs in not important. In order to complete the maneuver safely and to have the track mounted solely on the exterior of the tower, the track must bank transition through a total of about 180 degrees towards the tower, or through a total of about 180 degrees bank transition away from the tower.

Figure 11:
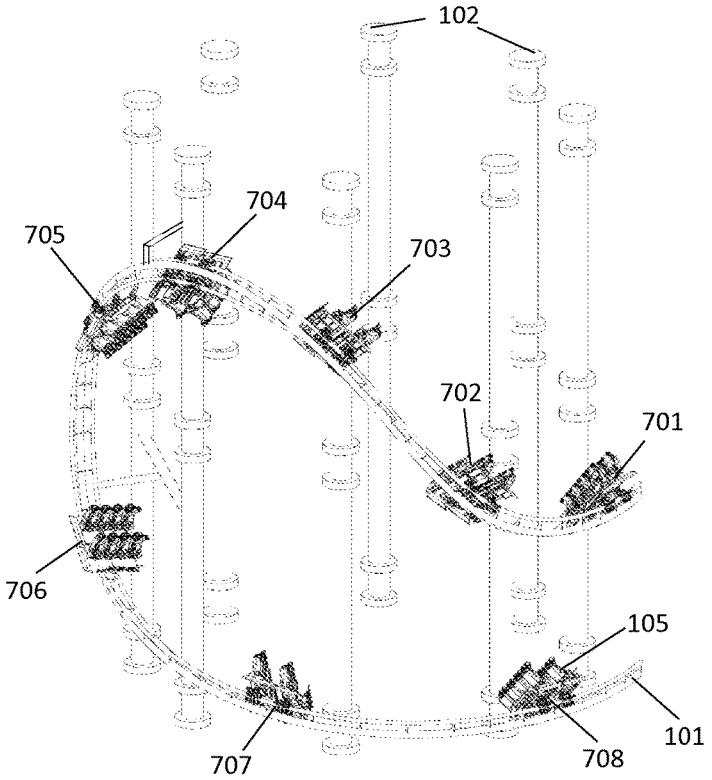
FIG. 11 is another perspective view of the loop turn of FIG. 10.
Figure 12:
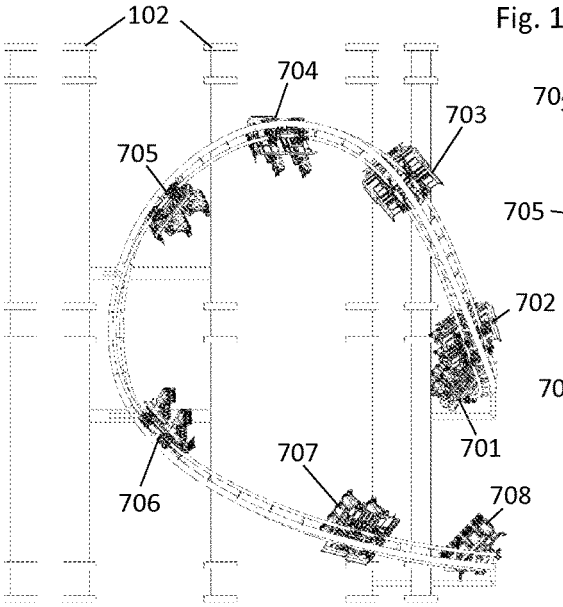
FIG. 12 is a first side plan view of FIG. 11.
Figure 13:
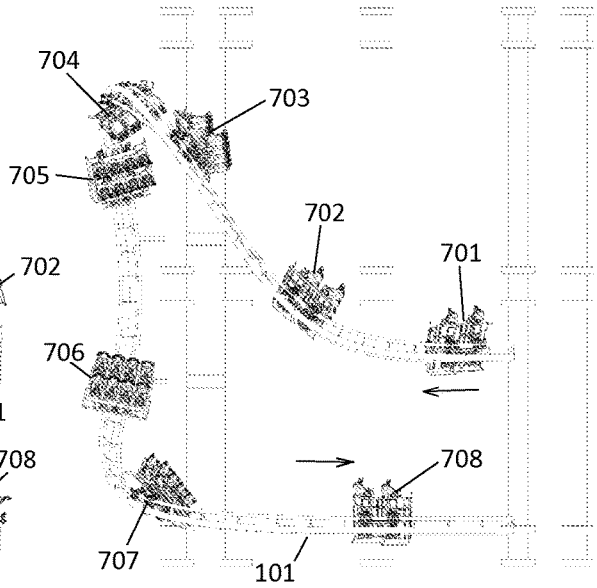
FIG. 13 is a second side plan view of FIG. 11.

Referring next to FIGS. 10-13, a loop turn 710 with a generally tear drop shape configuration that banks toward the support pillars is depicted. The track 101 is mounted on support pillars 102. For easy of viewing only the loop turn segment of the track is shown. It is to be understood that the track would continue both before and after the loop turn. The number, size and spacing of the support pillars will depend on the height and total diameter of the tower 110; no limitation as to the size and spacing of the pillars is intended, or should be inferred. The mounting braces 103, 104 are not shown in FIG. 10 and are shown in FIGS. 11-13. The number and size of the cross braces required to support the track 101 will depend on well-known engineering principles. Individual rider carriages 105 are shown spaced apart at different locations on the track 101. The location and spacing of the rider carriages shown is to illustrate the orientation of the track at a various locations on the turn. The depicted rider carriage configuration is not intended as an illustration of the actual spacing of the cars during operation of the tower ride. The ride can be operated with either individual rider carriages traveling the track or with trains of rider carriages (not shown). No limitation to the number, spacing or type of rider carriages is intended or should be inferred.

The loop turn 710 starts with the rider carriage at a first position 701. The rider carriage is traveling in a first direction around the circumference of the tower indicated by arrow E (shown in FIG. 10). In the depicted embodiment, at the first position 701 the track is at a 60 degree bank right and a rider traveling at 40 MPH would experience approximately 3.5 Gs of force. The rider carriage travels along the track to a second position 702, where the track starts curving upward, and the track extends upward past a third location 703 to a fourth location 704 which is at approximately the highest point of the loop turn. It is to be understood that this is not the highest point of the overall track, but merely the highest location on this particular turn. At the fourth location 704 the track has banked 60 degrees right from the orientation in the first position 701. At the fourth location 704, a rider going 20 MPH will experience about 1.5 Gs of force in the depicted embodiment. The track 101 then curves downward to a fifth location 705 where the rider carriage 105 has a 160 degree bank right. A rider traveling at 30 MPH would experience about 1.5 Gs here. The track 101 then extends downward to a sixth location 706. The track has rotated about 20 degrees right to be at a 0 degree bank at the sixth location 706. The track then continues along the bottom side of the tear drop to a seventh location 707. The rider carriage is now moving in a second direction around the circumference of the tower indicated by arrow F (shown in FIG. 10), which is substantially opposite the first direction indicated by arrow E. The track continues to an eighth position 708 where the track is banked 60 degrees left in the depicted embodiment. A rider traveling at 45 MPH would experience about 3.5 Gs at this position 708 in the depicted embodiment.

Figure 14:
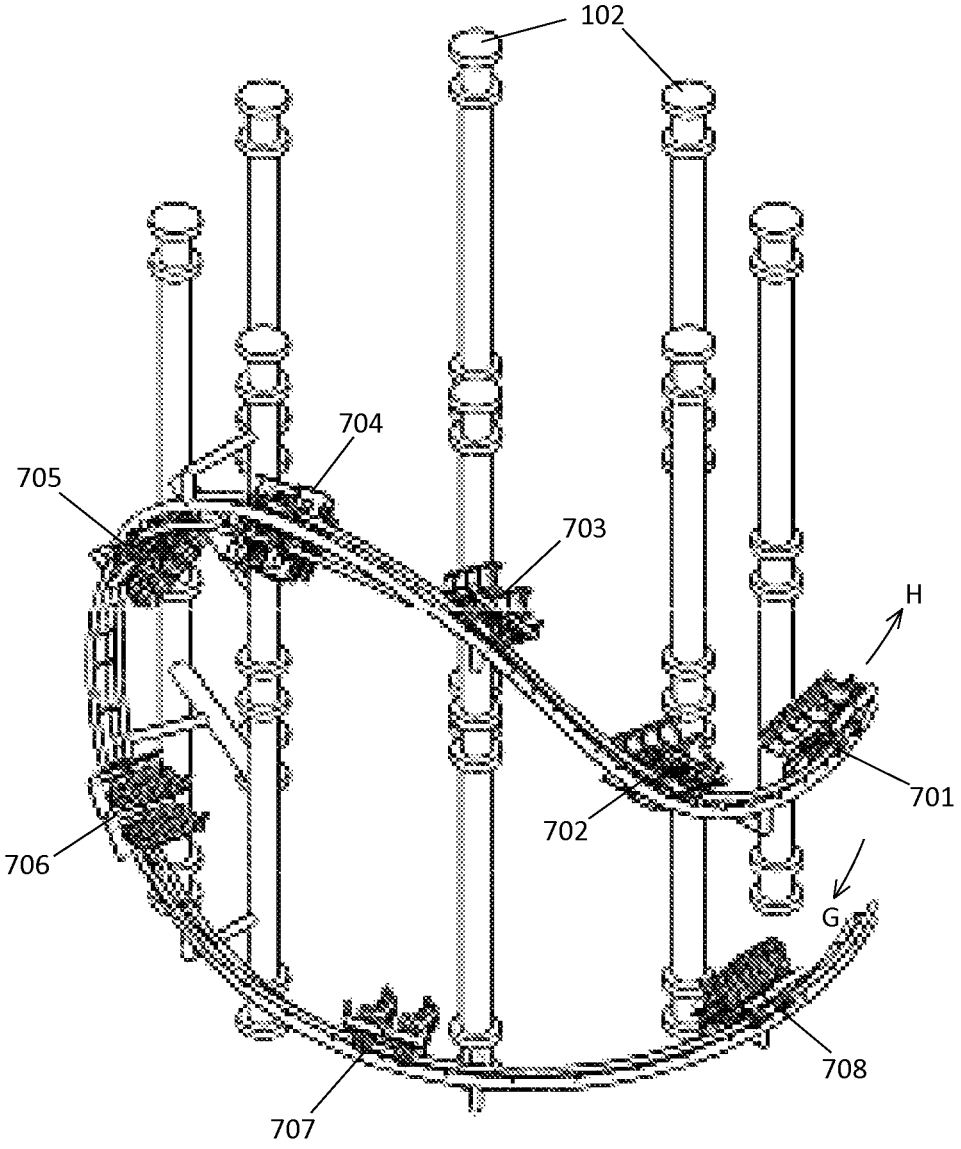
FIG. 14 is a perspective view of the loop turn shown with the support pillars, the track and some of the track supports depicted with the cars traveling in opposite direction.

FIG. 14 depicts the track loop turn 710 with the rider cars going in the opposite direction. The track is identical to the embodiment shown in FIGS. 10-13; the cars are just being run in the opposite direction, as is possible with this loop turn 710. The rider carriage starts at position 708 traveling in the direction indicated by arrow G and travels through the turn 710 to position 701 traveling in the direction indicated by arrow H, which is substantially opposite the direction indicated by arrow G. The forces felt by the riders may be different, given the change of direction and the rise as opposed to a drop.

Figure 15:
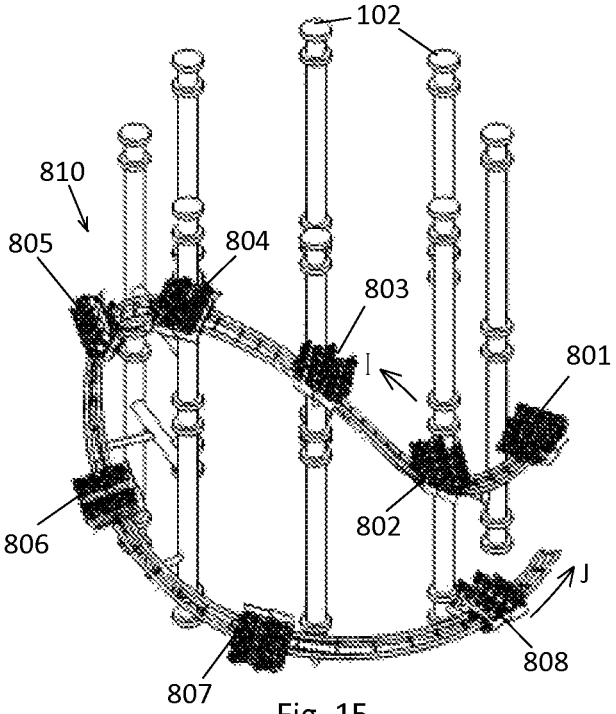
FIG. 15 is a perspective view of the loop turn shown with the track rotating outward from the tower with the support pillars, the track and some of the track supports depicted.
Figure 16:
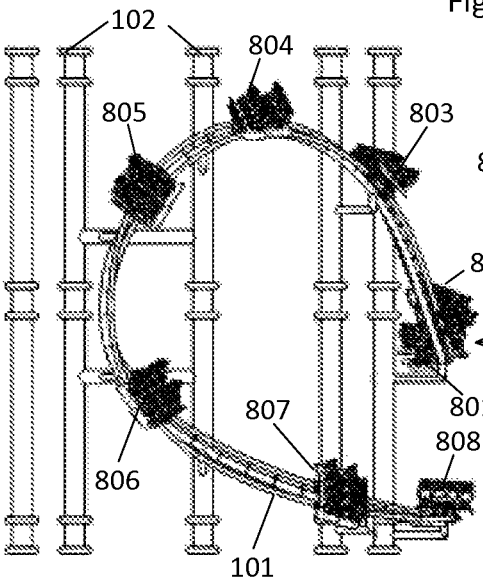
FIG. 16 is a first side plan view of FIG. 15.
Figure 17:
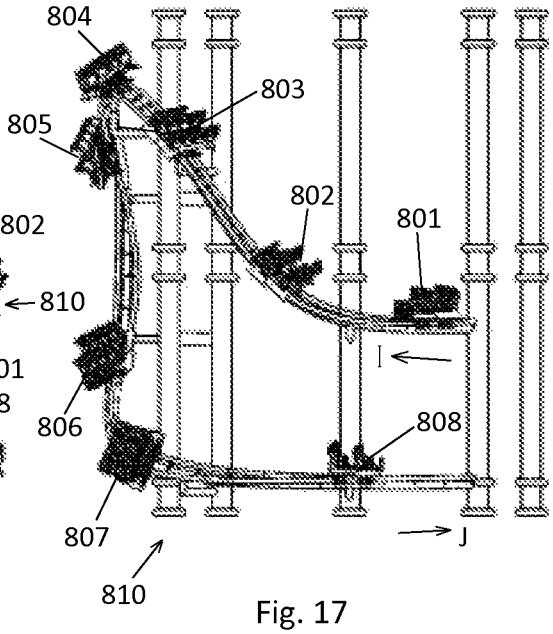
FIG. 17 is a second side plan view of FIG. 15.

Referring next to FIGS. 15-17, a loop turn 810 with a generally tear drop shape configuration that banks away from the support pillars is depicted. The track 101 is mounted on support pillars 102. For ease of viewing, only the loop turn segment of the track is shown. It is to be understood that the track would continue both before and after the loop turn. The number, size and spacing of the support pillars will depend on the height and total diameter of the tower 110; no limitation as to the size and spacing of the pillars is intended, or should be inferred. The number and size of the cross braces required to support the track 101 will depend on well-known engineering principles. Individual rider carriages 105 are shown spaced apart at different locations on the track 101. The location and spacing of the rider carriages shown is to illustrate the orientation of the track at various locations on the turn. The depicted rider carriage configuration is not intended as an illustration of the actual spacing of the cars during operation of the tower ride. The ride can be operated with either individual rider carriages traveling the track or with trains of rider carriages (not shown). No limitation to the number, spacing or type of rider carriages is intended or should be inferred.

The loop turn 810 starts with the rider carriage at a first position 801. The rider carriage is traveling in a first direction around the circumference of the tower indicated by arrow I (shown in FIG. 15). In the depicted embodiment, at the first position 801 the track is at a 60 degree bank left. The rider carriage travels along the track to a second position 802, where the track starts curving upward, and the track continues upward past a third location 803 to a fourth location 804 which is at approximately the highest point of the loop turn. It is to be understood that this is not the highest point of the overall track, but merely the highest location on this particular turn. The track 101 then curves downward to a fifth location 805. The track 101 then continues downward to a sixth location 806. The track has rotated to be at a 0 degree bank at the sixth location 806. The track then continues along the bottom side of the tear drop to a seventh location 807. The rider carriage is now moving in a second direction around the circumference of the tower indicated by arrow J (shown in FIG. 15), which is substantially opposite the first direction indicated by arrow I. The track extends to an eighth position 808 where the track is banked 0 degrees in the depicted embodiment.

Figure 18:
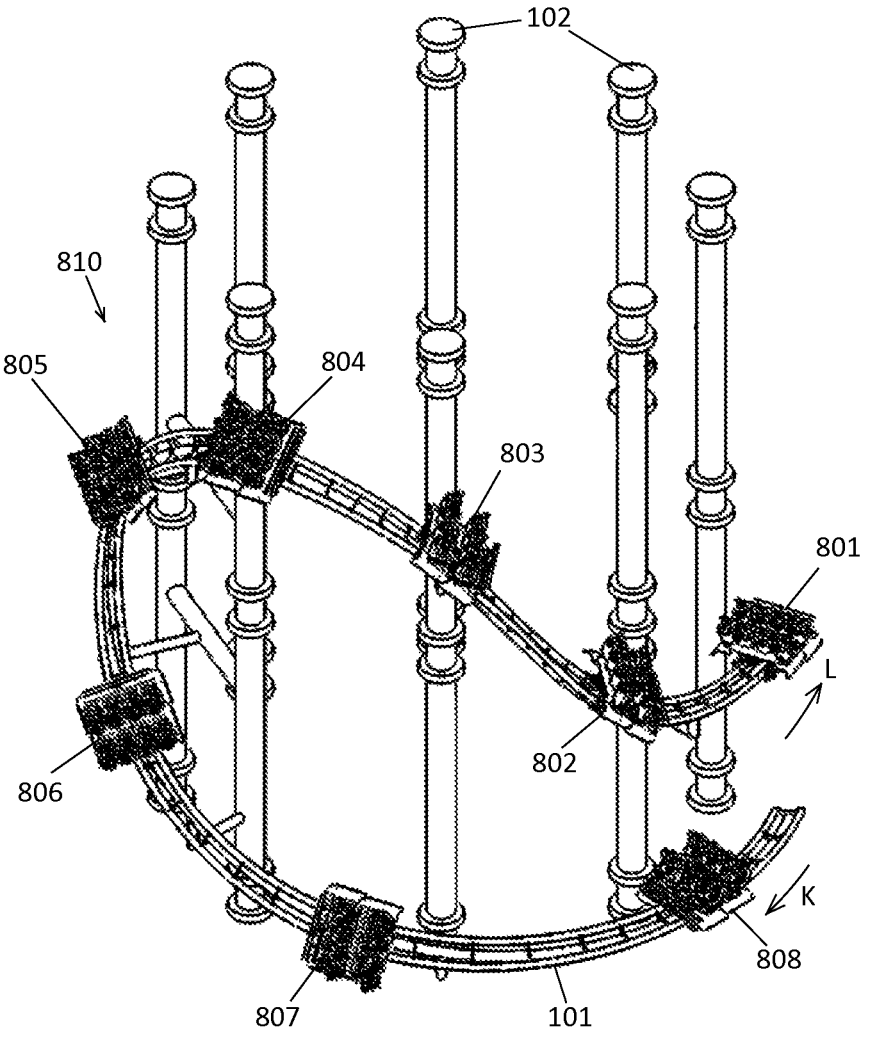
FIG. 18 is perspective view of the loop turn shown with the track rotating outward with the support pillars, the track and some of the track supports depicted with the cars traveling in opposite direction.

FIG. 18 depicts the track loop turn 810 with the rider cars going in the opposite direction. The track is identical to the embodiment shown in FIGS. 15-17; the cars are just being run in the opposite direction, as is possible with this loop turn 810. The rider carriage starts at position 808 traveling in the direction indicated by arrow K and travels through the turn 810 to position 801 traveling in the direction indicated by arrow L. The forces felt by the riders may be different, given the change of direction and the rise as opposed to a drop.

The velocity, bank angle and G-force through the loop turn will vary based upon the tower diameter. The loop turn can occur with or without braking. The banking roll can occur towards the tower with 180 degrees of bank transition, or by rolling away from the tower with 180 degrees of bank transition. The loop turn can also be run in the reverse direction from the depicted embodiments, with the rider carriage ending up higher than it started without the rider carriages being powered upward. Further, exactly where in the overall loop turn the banking occurs is not important. In order to complete the maneuver safely and to have the track mounted solely on the exterior of the tower, the track must bank transition through a total of about 180 degrees towards the tower, or through a total of about 180 degrees bank transition away from the tower.

Figure 19:
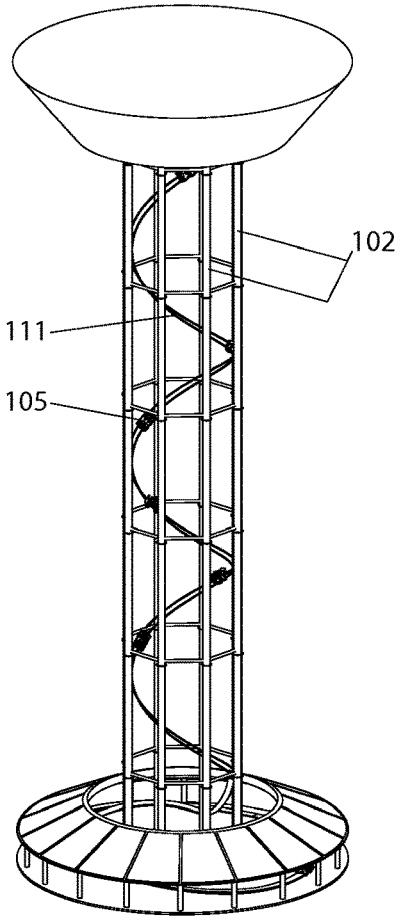
FIG. 19 is a perspective view of the tower showing the helical upward track only.
Figure 25:
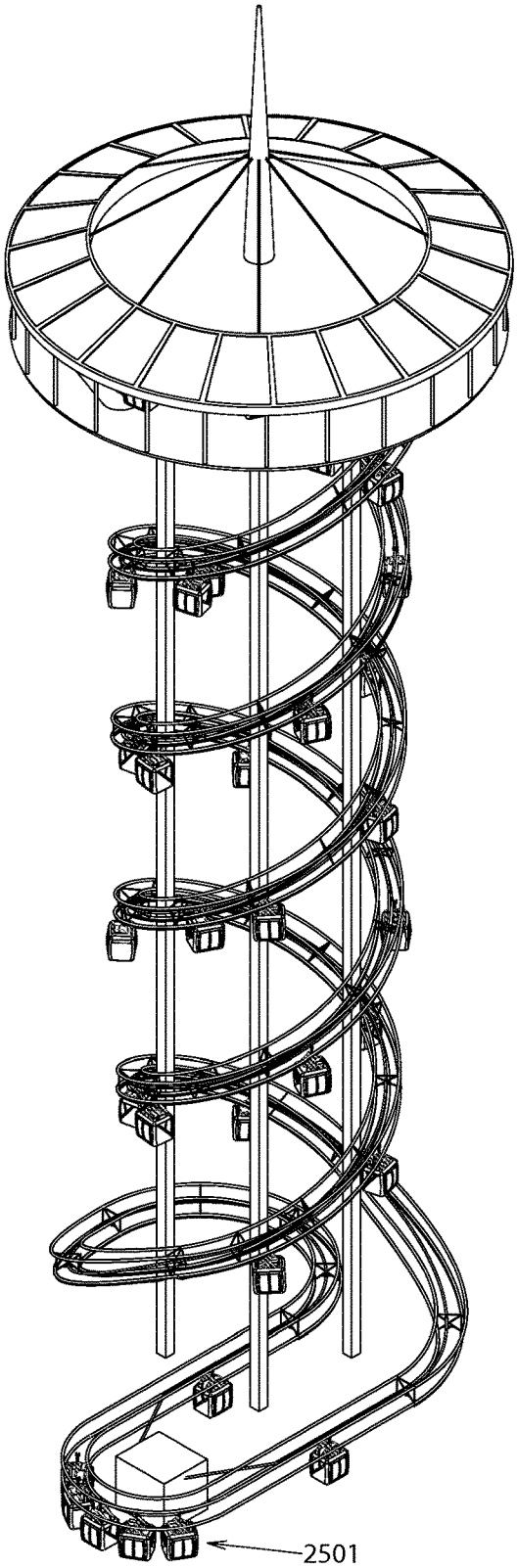
FIG. 25 is a perspective view of a viewing tower embodiment of the tower ride.

As mentioned above, the height of the tower and the helical configuration of the upward track 111 on the tower of the depicted embodiments (as shown in FIG. 19 for example) make standard chain drive for rider carriages 105 impractical. This is also true for a viewing ride mounted on a tower with a helical upward track 111, an embodiment of which is shown in FIG. 25. Instead, a wire rope lift system is disclosed to propel the rider carriages 105 up the helical track 111. The rider carriages 105 are propelled by a continuously recirculating wire rope/cable 901 similar to the lift systems used in gondola lifts.

Figure 20:
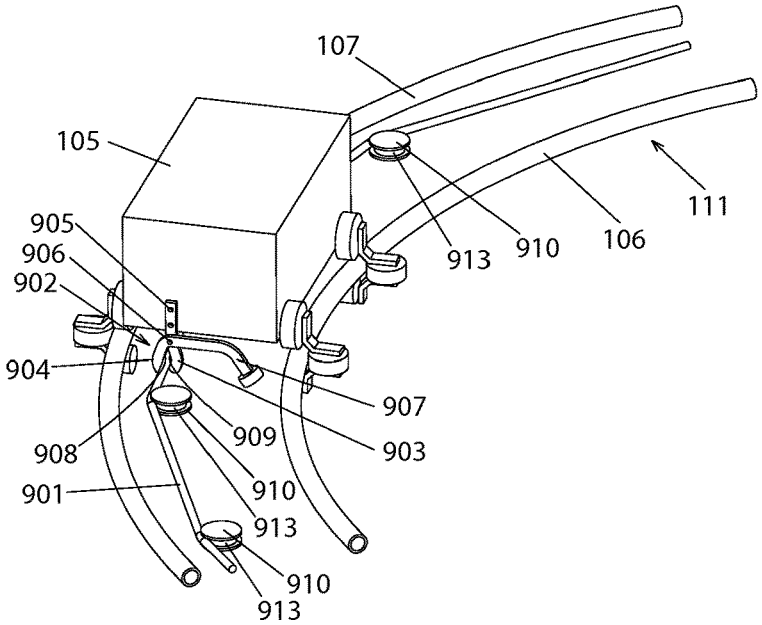
FIG. 20 is a perspective schematic view of a car mounted on the track with a wire rope drive system.

Referring next to FIG. 20, the rider carriages 105 connect to the wire rope 901 via a mechanical clamping grip 902 mounted to the rider carriages 105. The clamping grip 902 has two pivotally mounted arms 903, 904. Each arm has facing gripping surfaces 908, 909. Arm 903 is fixedly mounted to the rider carriage 105 at location 905. Arm 904 is pivotally mounted to arm 903 at location 906. The clamping grip 902 is biased closed, for example with heavy springs (not shown). Arm 904 has a control arm 907 extending from the opposite side of pivot 906 from gripping surface 908 in the depicted embodiment.

Along the helical upward track 111, the wire rope 901 is guided by rotating guide sheaves 910 that are integral to the track structure and spaced at regular intervals along the track. Sheaves 910 may be mounted to the track structure, such as the cross ties and strong back, or may be mounted to the track support structure. The wire rope 901 is strung between the regularly spaced guide sheaves 910, and follows a faceted path with straight sections between the guide sheaves 910 with the wire rope resting in grooves 913 around the sheaves. The path between any two grooves of adjoining guide sheaves would be in a substantially straight line. The wire rope 901 must be under sufficient tension to force the wire rope in the grooves 913 so that the groove of the sheaves 910 holds the wire rope up against gravity and in the desired path. In order for the tensioning to work, the overall path of the wire rope must be either substantially circular in a horizontal plane, or substantially cylindrical. The exact spacing of the drive sheaves 910 and the amount of tension that the wire rope 901 will need to be under will depend on the radius of the turns of the helical track 111 and the amount of upward incline. The wire rope 901 and guide sheaves 910 may be positioned at approximately the same elevation as the track rails 106, 107, as seen in FIGS. 20-22.

Figure 21:
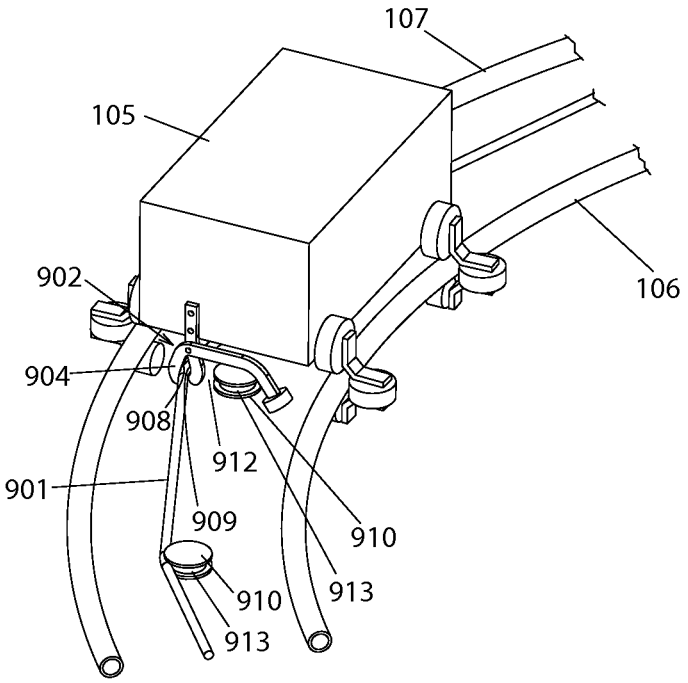
FIG. 21 is a schematic view of a car mounted on the track with the clamping mechanism moving around a guide sheave.

As shown in FIG. 21, the mechanical clamping grip 902 is positioned on the rider carriage 105 at a location which ensures a controlled clearance gap 912 between the grip 902 and the guide sheaves 910 such that (a) the grip will not interfere with the guide sheaves as the grip passes by any sheave, and (b) the wire cable is not pulled away from the sheave any farther than necessary as the grip passes by. The typical path of the wire rope 901 is offset from the natural path by the gripping surfaces 908, 909 of the clamping grip 902 on the rider carriage 105, such that the clamping grip 902 causes the wire rope 901 to move away from its natural path as the carriage moves by as seen in FIG. 21, thus pulling the wire rope 901 away from the sheaves 910 by a chosen clearance gap 912. The natural path of the gripping surfaces 908, 909 on the clamping grip 902 formed by the rider carriage 105 moving along the track 101 is substantially in-plane with the plane of the guide sheaves, such that as the rider carriage 105 proceeds beyond a guide sheave 910, the wire rope 901 naturally returns to the groove 913 of the guide sheave for guided operation.

Figure 22:
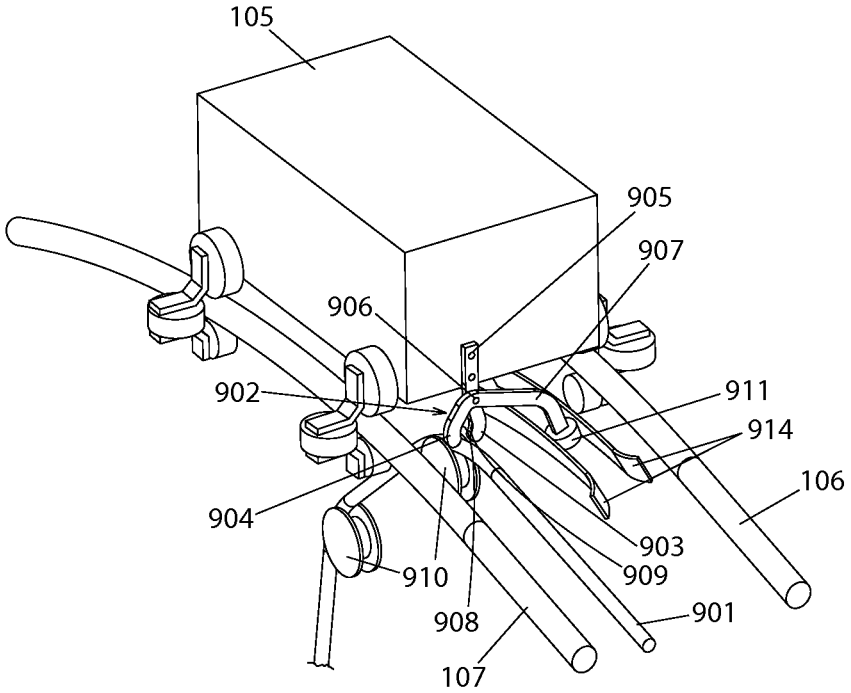
FIG. 22 is a schematic view of a car mounted on the track with the clamping mechanism disengaging from the wire rope.

Referring next to FIG. 22, the clamping grip 902 is opened and closed to allow the rider carriage 105 to attach to (and detach from) the continuously moving wire rope 901 by means of a cam system. In the depicted embodiment, the spring loaded grip 902 is actuated by a control arm 907, which includes a cam following roller 911. At locations where the clamping grip 902 attaches to the wire rope 901 or detaches from the wire rope, the path of the wire rope 901 is controlled by the guide sheaves 910 such that the wire rope 901 intersects the natural path of the gripping surfaces 908, 909 on the clamping grip. At that location, the cam following roller 911 of the control arm 907 moves between the cam surfaces 914. The cams surfaces 914 are positioned such that the control arm 907 is moved, causing the arm to pivot at position 906 to open the clamping grip 902. The grip-controlling cams 914 are configured such that the clamping grip 902 opens or closes approximately at the same position where the natural paths of the gripping surfaces 908, 909 of the mechanical grip and the wire rope 901 intersect, thus minimizing the relative motion between the wire rope and the gripping surfaces on the mechanical grip and allowing the rider carriage 105 to attach or detach from the wire rope 901.

In the depicted embodiment, the wire rope forms a continuous circuit, recirculating through a system of guide sheaves and motorized drive sheaves. In another embodiment of the roller coaster, the wire rope follows the upward helical track and then drops directly down to the bull wheel at the bottom of the tower. In one viewing tower ride embodiment shown in FIG. 25, the wire rope runs the whole track, both up and down. This allows the weight of the descending rider carriages to balance the weight of the ascending rider carriages, putting less strain on the wire rope drive system. Another possible embodiment would be to have two separate wire ropes, one for the ascending track and one for the descending track.

Figure 23:
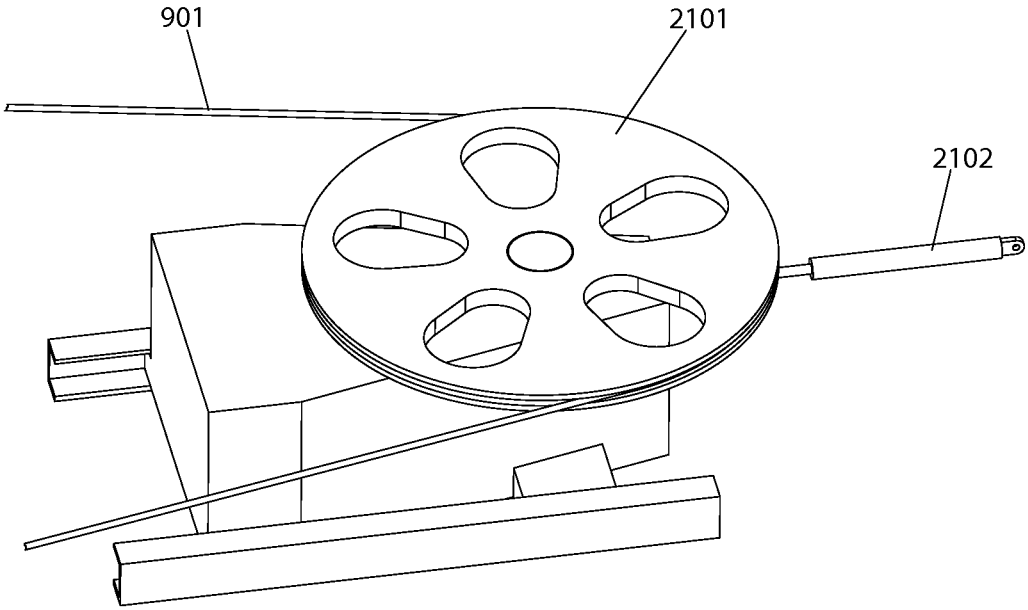
FIG. 23 is a perspective view of the bull wheel drive of the wire rope.

Referring next to FIG. 23, the wire rope 901 may be propelled by a single drive sheave 2101, or "bull wheel," which may be located under the tower. The bull wheel drive system may be mounted on a linear motion track so that a hydraulic actuator 2102 may be used to provide a controlled tension in the wire rope.

Figure 24:
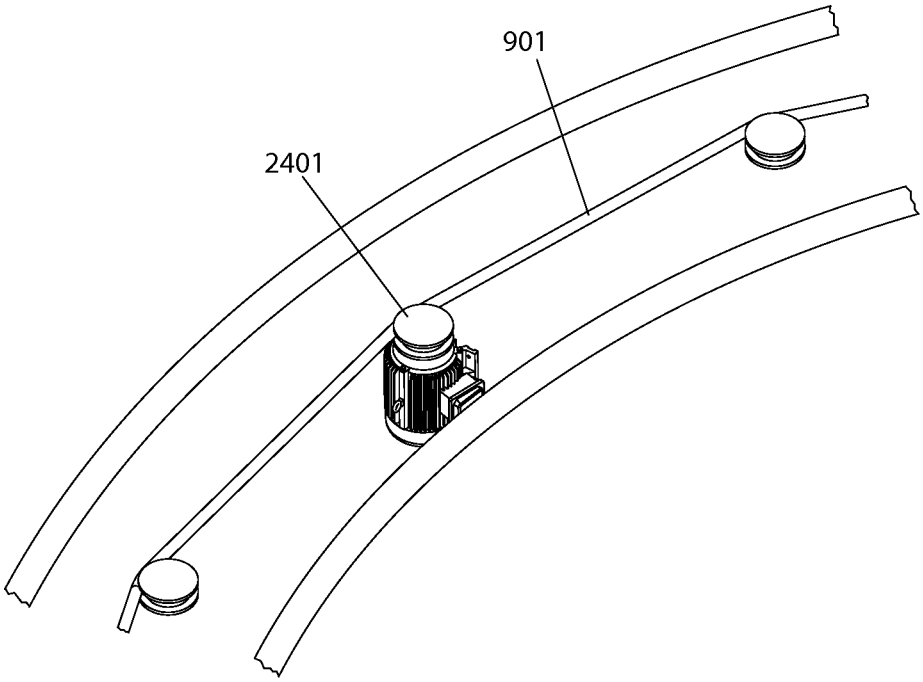
FIG. 24 is a perspective view of an alternative drive system for the wire rope.

Alternatively, the wire rope 901 may be propelled by multiple drive sheaves 2401 distributed along the path of the wire rope, as seen in FIG. 24. The drive system can be utilized to propel a variety of rider carriages, such as roller coaster vehicles, gondola cabin vehicles, and others on the tower rider. The rider carriages may detach from the wire rope at the top of the lift and then follow a traditional roller coaster style path under gravity propulsion.

Alternatively, as depicted in FIG. 25, a rider carriage may remain attached to the wire rope for the descent leg down from the top of the tower to form a viewing ride. Further, the capability to detach from and re-attach to the wire rope provides the option of holding vehicles in queue for passenger ingress and egress into and out of stationary vehicles. Here, vehicles may be indexed sequentially through a loading station 2501 and driven using a secondary intermittent propulsion system such as a tire friction drive or the like (not shown). Vehicle queues for passenger loading may be placed at any position along the path of the wire rope, and multiple loading stations on a single wire rope circuit are possible.

While a number of exemplary aspects and embodiments have been discussed above, those of skill in the art will recognize certain modifications, permutations, additions and sub-combinations thereof. It is therefore intended that the following appended claims hereinafter introduced are interpreted to include all such modifications, permutations, additions and sub-combinations which are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by certain embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure.

In general the terms and phrases used herein have their art-recognized meaning, which can be found by reference to standard texts, journal references and contexts known to those skilled in the art. The above definitions are provided to clarify their specific use in the context of the invention.

We claim:

1. A roller coaster ride mounted on a tower comprising:

a support tower;

a track mounted on the support tower, the track having an ascending and descending section;

at least one rider carriage slidably mounted on the track; and at least one drop turn of the track, the drop turn comprising:

a part of the descending section of the track extending in a first direction around on an outer perimeter of the tower, the track turning downward and banking about 180 degrees towards the tower while the track drops and turns about 180 degrees such that the track ends up extending in a second direction around the outer perimeter of the tower, the second direction being substantially opposite the first direction;

wherein the track is mounted solely on an exterior of the support tower for the length of the drop turn and the drop turn occurs entirely within the descending section of the track.

2. The roller coaster ride of claim 1, wherein the drop turn is located entirely within a distance of two track widths out from the outer perimeter of the support tower.

3. The roller coaster ride of claim 1, wherein the track does not cross over itself for the length of the drop turn.

4. The roller coaster ride of claim 1, wherein the drop turn forms substantially a C shape.

5. A roller coaster ride mounted on a tower comprising:

a support tower;

a track mounted on the support tower, the track having an ascending and descending section;

at least one rider carriage slidably mounted on the track; and at least one drop turn of the track, the drop turn comprising:

a part of the descending section of the track extending in a first direction around on an outer perimeter of the tower, the track turning downward and banking about 180 degrees away from the tower while the track drops and turns about 180 degrees such that the track ends up extending in a second direction around the outer perimeter of the tower, the second direction being substantially opposite the first direction;

wherein the track is mounted solely on an exterior of the support tower for the length of the drop turn and the drop turn occurs entirely within the descending section of the track.

6. The roller coaster ride of claim 5, wherein the drop turn is located entirely within a distance of two track widths out from the outer perimeter of the support tower.

7. The roller coaster ride of claim 5, wherein the track does not cross over itself for the length of the drop turn.

8. The roller coaster ride of claim 5, wherein the drop turn forms substantially a C shape.

9. A roller coaster ride mounted on a tower comprising:

a support tower;

a track mounted on the support tower, the track having an ascending and descending section;

at least one rider carriage slidably mounted on the track; and at least one loop turn of the track, the loop turn comprising:

a part of the descending section of the track extending in a first direction around on an outer perimeter of the tower, the track extending upward and then dropping while banking about 180 degrees toward the tower to end up extending a second direction around the outer perimeter of the tower, the second direction being substantially opposite the first direction;

wherein the track is mounted solely on an exterior of the support tower for the length of the loop turn and the loop turn occurs entirely within the descending section of the track.

10. The roller coaster ride of claim 9, wherein the loop turn is located entirely within a distance of two track widths out from the outer perimeter of the support tower.

11. The roller coaster ride of claim 9, wherein the track does not cross over itself for the length of the loop turn.

12. The roller coaster ride of claim 9, wherein the loop turn forms substantially a tear drop shape.

13. A roller coaster ride mounted on a tower comprising:

a support tower;

a track mounted on the support tower, the track having an ascending and descending section;

at least one rider carriage slidably mounted on the track; and at least one loop turn of the track, the loop turn comprising:

the track extending in a first direction around on an outer perimeter of the tower, the track extending upward and then dropping while banking about 180 degrees away from the tower to end up extending in a second direction around the outer perimeter of the tower, the second direction being substantially opposite the first direction;

wherein the track is mounted solely on an exterior of the support tower for the length of the loop turn and the loop turn occurs entirely within the descending section of the track.

14. The roller coaster ride of claim 13, wherein the loop turn is located entirely within a distance of two track widths out from the outer perimeter of the support tower.

15. The roller coaster ride of claim 13, wherein the track does not cross over itself for the length of the loop turn.

16. The roller coaster ride of claim 13, wherein the loop turn forms substantially a tear drop shape.

17. An amusement ride mounted on a tower comprising:

a tower comprising tower supports, the tower being at least 45 meters tall;

a helical ascending track mounted on an inside of the tower supports;

a descending track mounted on an outer surface of the tower supports, the ascending and descending tracks connected to form a continuous loop track;

at least one rider carriage movably mounted on two parallel rails of the continuous loop track;

a loop of wire rope movably mounted within the ascending track and extending a length of the ascending track and being driven in an upward direction by a drive means, the loop of wire rope being under tension;

the wire rope being guided on a path by rotating guide sheaves mounted on the ascending track and spaced at regular intervals along the ascending track, the wire rope being held in place against gravity by grooves around the guide sheaves;

a path of the wire rope between any two adjoining guide sheaves being a substantially straight line;

the grooves of the guide sheaves being substantially co-planar with the two parallel rails for the length of the ascending track that the rider carriage is driven upward;

the loop of wire rope being tensioned to hold the wire rope in the grooves;

the rider carriage having a mechanical clamping grip mounted to the rider carriage such that a pair of facing clamping surfaces of the mechanical clamping grip extend beneath said rider carriage;

the facing clamping surfaces being arranged to be substantially co-planar with the path of the wire rope and capable of engaging the wire rope to attach the rider carriage to the wire rope, the wire rope functioning to drive the rider carriage up the ascending track when the mechanical clamping grip is attached to the wire rope;

the mechanical clamping grip being located on the rider carriage such that when the mechanical clamping grip is attached to the wire rope and the rider carriage is driven past a rotating guide sheave, there is a gap between the mechanical clamping grip and the guide sheave such that the wire rope is pulled from the groove of the guide sheave and out of engagement with that specific guide sheave while the mechanical clamping grip passes the guide sheave;

said mechanical clamping grip having a first and second arm, said arms being pivotally attached together;

said first arm being fixedly mounted to the rider carriage;

said second arm being pivotally mounted to said first arm at a pivoting location;

said mechanical clamping grip being biased closed;

said second arm having a control arm extending from on an opposite side of the pivoting location from a clamping location;

wherein the control arm is configured to engage with a cam surface to open the mechanical clamping grip such that the mechanical clamping grip engages the wire rope; and the mechanical clamping grip engaging the wire rope such that the rider carriage is attached to the wire rope and driven up the helical ascending track.

18. The amusement ride of claim 17, wherein the rider carriage is attached to the wire rope for the length of the ascending track.

19. The amusement ride of claim 17, wherein the grooves of the guide sheaves are in the same plane as the two parallel rails for the length of the ascending track that the rider carriage is driven upward.

20. The amusement ride of claim 17, wherein the descending track is mounted substantially within a hollow cylinder of space defined by the outer surface of the tower supports on an inside surface of the hollow cylinder and a surface two track widths out from the inner surface on an outside surface of the hollow cylinder, excluding any passenger loading section of the continuous loop track.

* * * * *